US011819981B2

(12) United States Patent
Badeaux

(10) Patent No.: US 11,819,981 B2
(45) Date of Patent: Nov. 21, 2023

(54) MAGNETIZED PIPE STAND ASSEMBLY

(71) Applicant: Bevan Badeaux, Port Barre, LA (US)

(72) Inventor: Bevan Badeaux, Port Barre, LA (US)

( * ) Notice: Subject to any disclaimer, the term of this patent is extended or adjusted under 35 U.S.C. 154(b) by 78 days.

(21) Appl. No.: 17/684,965

(22) Filed: Mar. 2, 2022

(65) Prior Publication Data

US 2023/0278172 A1 Sep. 7, 2023

(51) Int. Cl.
*B25B 11/00* (2006.01)
*B25H 1/00* (2006.01)

(52) U.S. Cl.
CPC ..... *B25B 11/002* (2013.01); *B25H 1/0042* (2013.01)

(58) Field of Classification Search
CPC ..... B25B 11/00; B25B 11/02; B25H 1/00; B25H 1/0042
See application file for complete search history.

(56) References Cited

U.S. PATENT DOCUMENTS 1,393,766 A * 10/1921 Du Charme ..... B25B 1/20 269/215
2,524,168 A 10/1950 Harnish
3,313,505 A * 4/1967 Petrie ..... B25H 1/00 248/405
3,433,277 A * 3/1969 Ribley ..... B25H 1/06 269/296
3,661,378 A * 5/1972 Dodge ..... B25B 1/205 269/286
3,741,509 A * 6/1973 Kelly ..... F16M 11/046 248/161
4,540,147 A 9/1985 Lincourt
5,312,096 A 5/1994 Jasper
5,727,779 A 3/1998 Ramoski
5,863,035 A 1/1999 Howell
6,502,810 B1 1/2003 Ramoski
9,895,930 B2 * 2/2018 Trejo ..... B60B 30/08
11,090,781 B2 * 8/2021 Verhagen ..... F16M 11/245
2005/0218275 A1 * 10/2005 Keating ..... F16L 3/04 248/176.1
2019/0275643 A1 9/2019 Verhagen

FOREIGN PATENT DOCUMENTS

WO WO2019173088 9/2019

* cited by examiner

*Primary Examiner* — Lee D Wilson

(57) ABSTRACT

A magnetized pipe stand assembly includes a tripod that has a central stanchion which has a telescopically adjustable height. An adjusting screw is adjustably positioned in the second portion of the central stanchion. The adjusting screw is movable either upwardly or downwardly in the second portion of the stanchion. A pipe holder is coupled to the adjusting screw and the pipe holder has a pair of plates being perpendicularly oriented with each other to support a pipe. A pair of electromagnets is each integrated into a respective one of the plates of the pipe holder. Each of the electromagnets produces a magnetic field when the electromagnets are turned on to magnetically to restrain the pipe on the pipe holder thereby facilitating the pipe to be precisely welded.

11 Claims, 5 Drawing Sheets

MAGNETIZED PIPE STAND ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to pipe stand devices and more particularly pertains to a new pipe stand device for supporting a pipe in a horizontal orientation for welding. The device includes a tripod and a pipe holder attached to the tripod. The pipe holder includes a pair of angled plates for supporting a pipe in a horizontal orientation. The device includes a pair of electromagnets that are integrated into the angled plates to magnetically engage the pipe. In this way the pipe is restrained in a horizontal orientation to facilitate the pipe to be precisely welded.

(2) Description of Related Art Including Information Disclosed Under 37 CFR 1.97 and 1.98

The prior art relates to pipe stand devices including an adjustable pipe square that has a slide, a disk coupled to the slide and a stop positioned on the disk for squaring a pipe. The prior art discloses a jack stand that includes a tripod and a holder which has a V-shaped recess to holding a cylindrical object. The prior art discloses a welding jib device that includes a first support plate and a second support plate rotatably coupled to the first support plate for engaging a pipe fitting such that the pipe fitting can be oriented with a pipe for welding. The prior art discloses a clamping tool which includes a tripod and a V-shaped panel attached to the tripod for longitudinally supporting a cylindrical member. The prior art discloses a pipe clamp device that includes a V-shaped support and a clamp that is attached to the V-shaped support for clamping a cylindrical member. The prior art discloses a variety of pipe stands that each includes a stand and a supporting element which has a V-shaped recess for supporting a cylindrical member.

BRIEF SUMMARY OF THE INVENTION

An embodiment of the disclosure meets the needs presented above by generally comprising a tripod that has a central stanchion which has a telescopically adjustable height. An adjusting screw is adjustably positioned in the second portion of the central stanchion. The adjusting screw is movable either upwardly or downwardly in the second portion of the stanchion. A pipe holder is coupled to the adjusting screw and the pipe holder has a pair of plates being perpendicularly oriented with each other to support a pipe. A pair of electromagnets is each integrated into a respective one of the plates of the pipe holder. Each of the electromagnets produces a magnetic field when the electromagnets are turned on to magnetically to restrain the pipe on the pipe holder thereby facilitating the pipe to be precisely welded.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
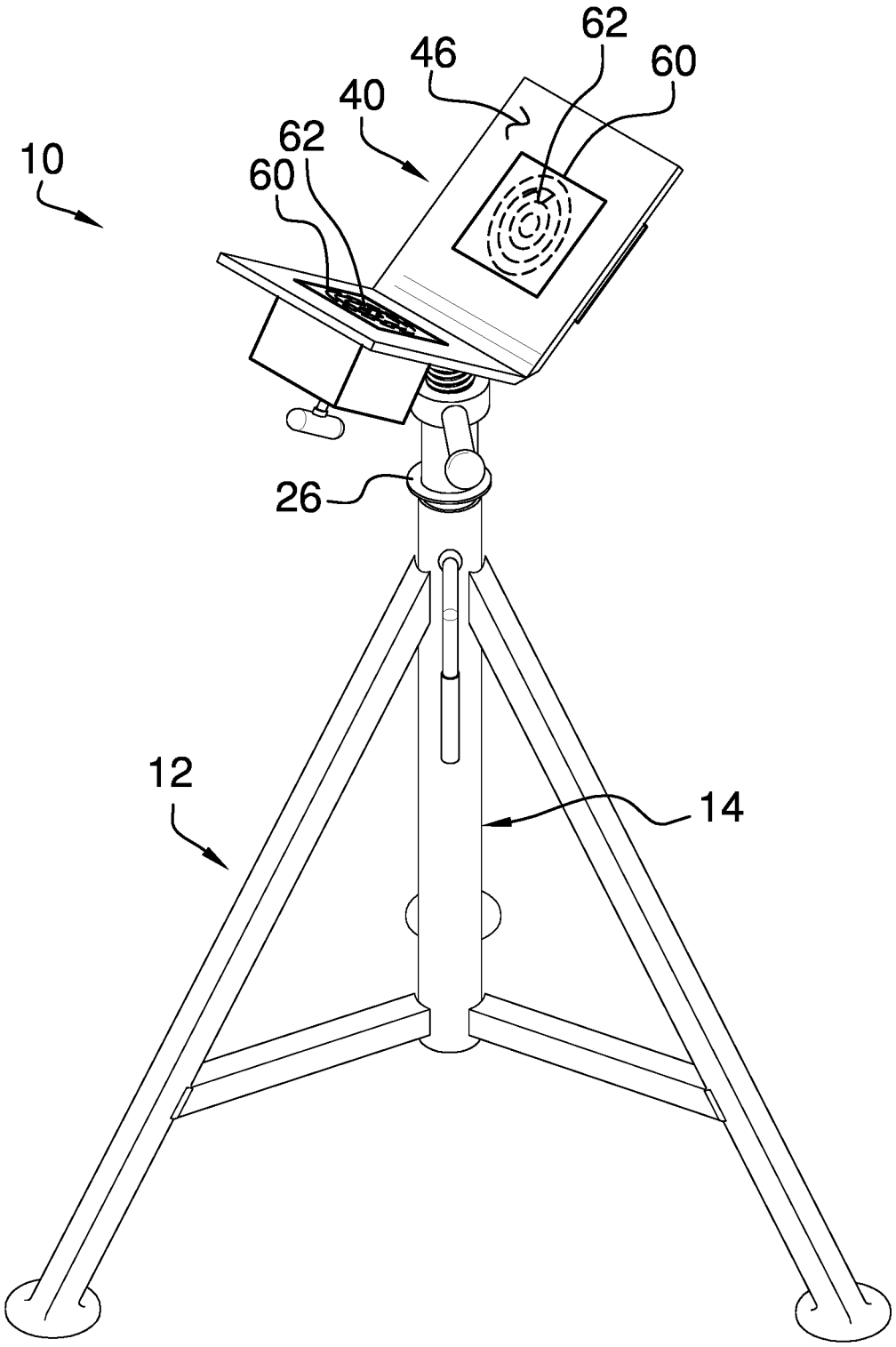
FIG. 1 is a top perspective view of a magnetized pipe stand assembly according to an embodiment of the disclosure.
Figure 2:
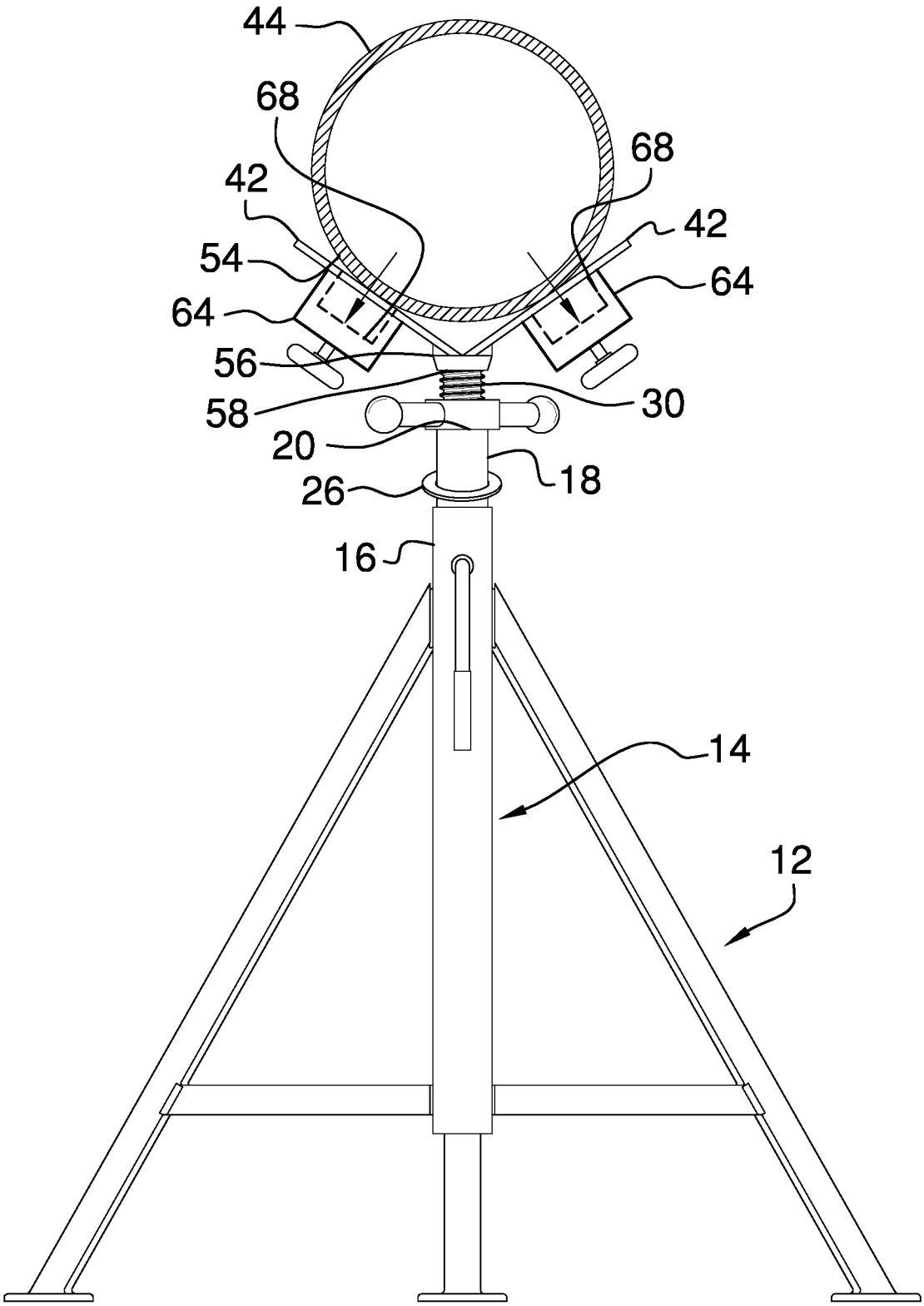
FIG. 2 is a front in-use view of an embodiment of the disclosure.
Figure 3:
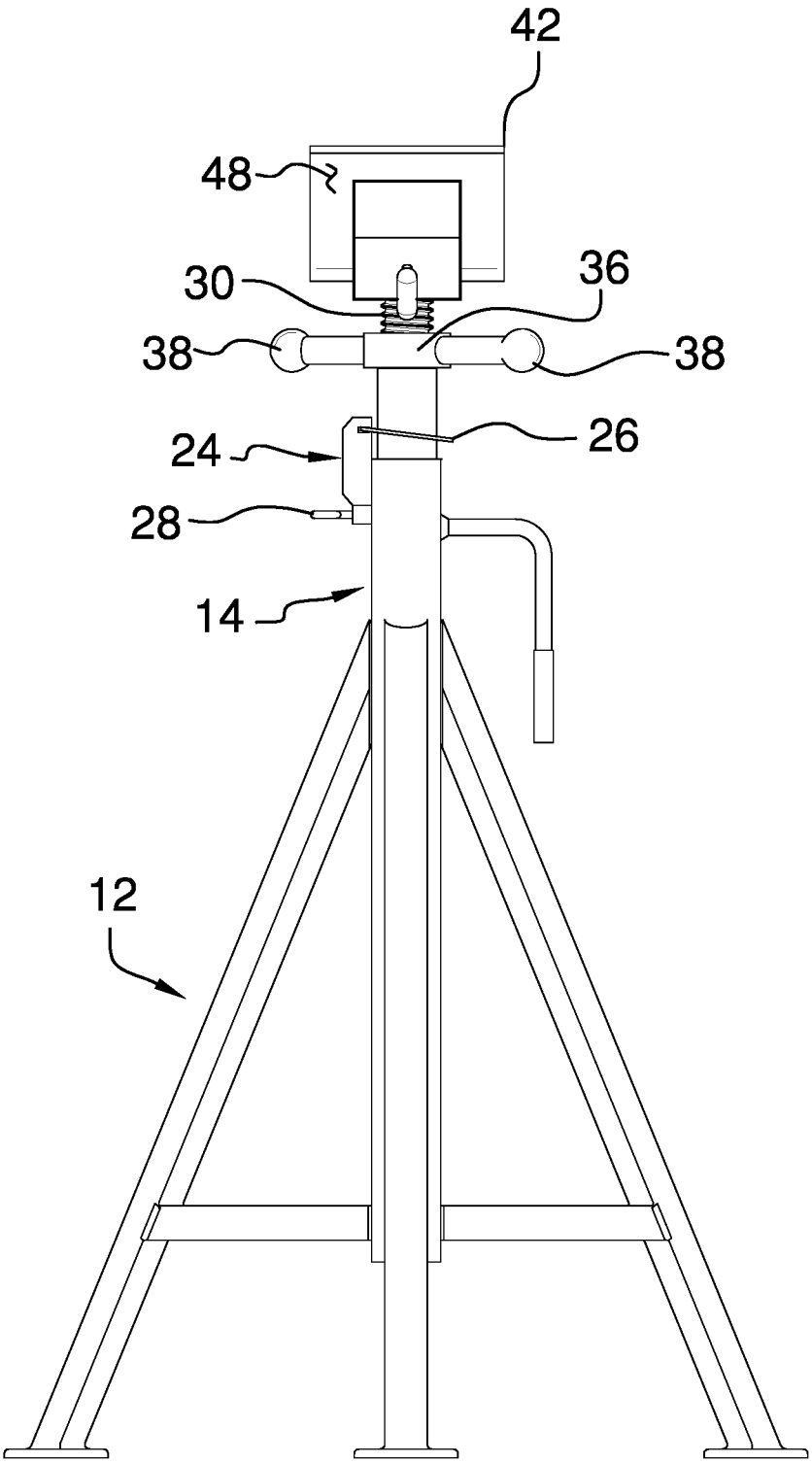
FIG. 3 is a right side view of an embodiment of the disclosure.
Figure 4:
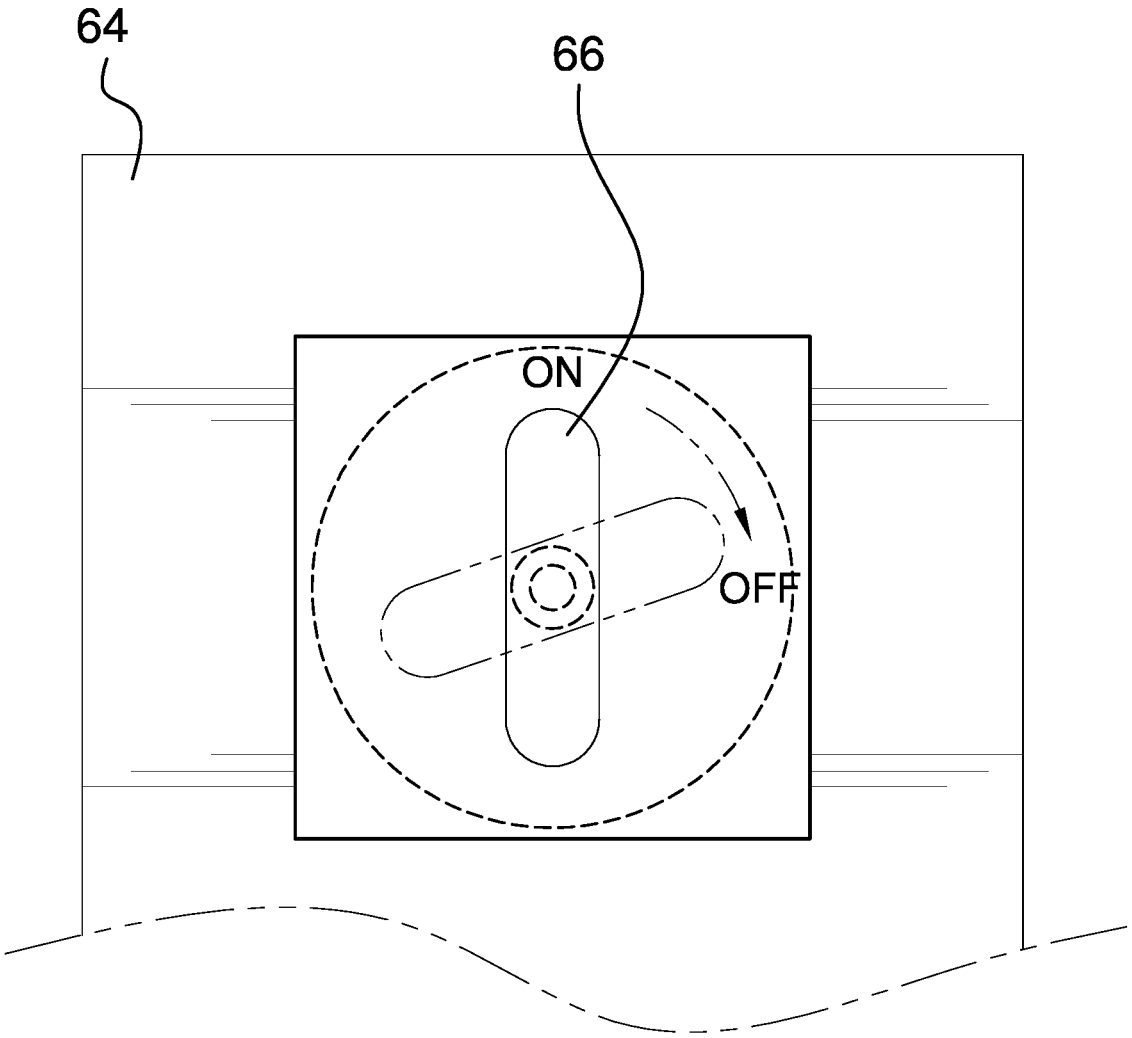
FIG. 4 is a detail view of a power switch on an electromagnet of an embodiment of the disclosure.
Figure 5:
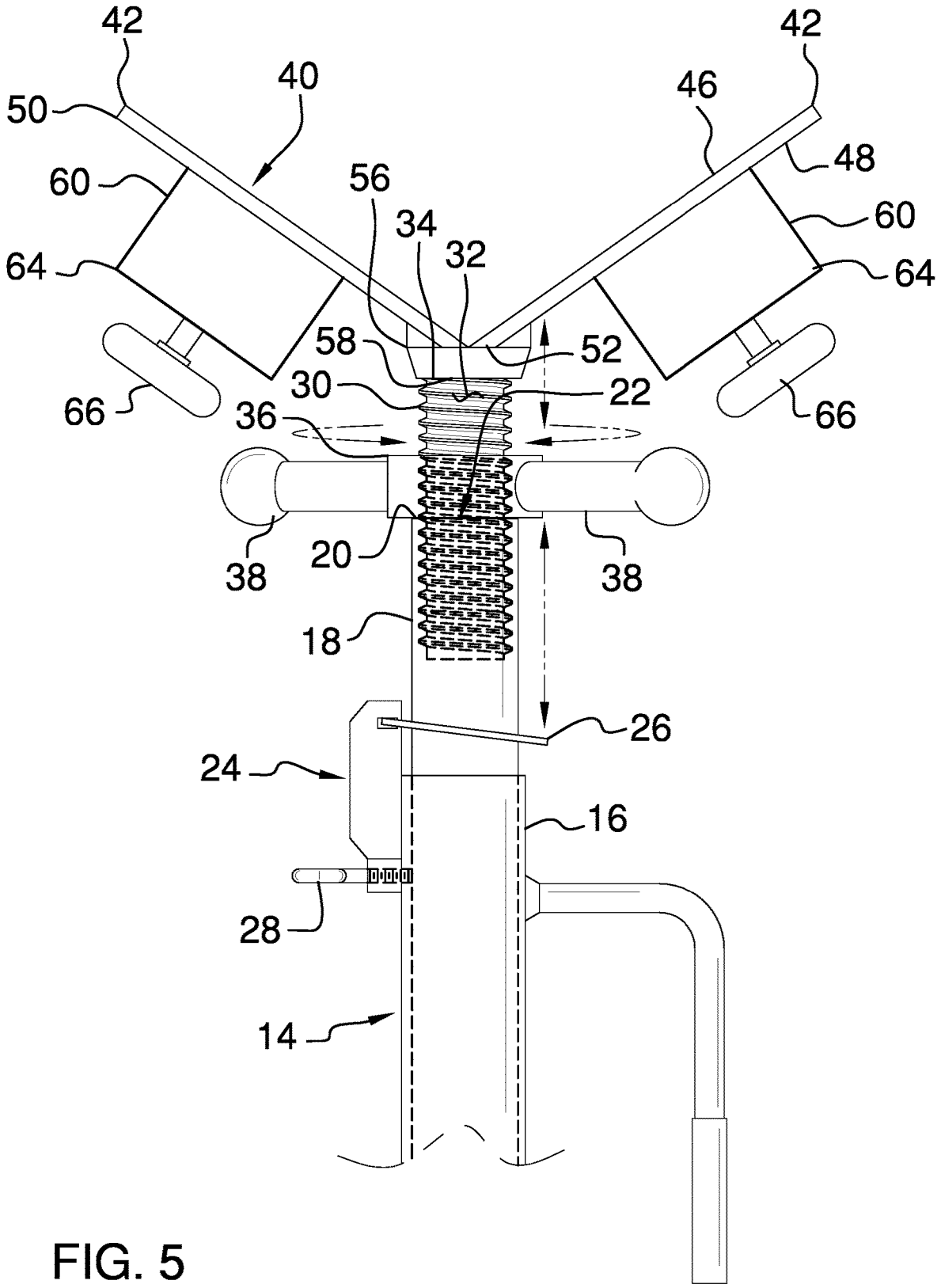
FIG. 5 is a phantom perspective view of a central stanchion and an adjustment screw of an embodiment of the disclosure.

With reference now to the drawings, and in particular to FIGS. 1 through 5 thereof, a new magnetized stand device embodying the principles and concepts of an embodiment of the disclosure and generally designated by the reference numeral 10 will be described.

As best illustrated in FIGS. 1 through 5, the magnetized pipe stand assembly 10 generally comprises a tripod 12 that has a central stanchion 14. The central stanchion 14 comprises a first portion 16 which slidably receives a second portion 18 such that the central stanchion 14 has a telescopically adjustable height. The second portion 18 of the central stanchion 14 has an upper end 20 and the upper end 20 has a well 22 extending downwardly into the second portion 18. The tripod 12 and the central stanchion 14 have a weight capacity of at least 2500.0 pounds thereby facilitating the tripod 12 and the central stanchion 14 to support steel pipe that is commonly employed in the pipe fitting industry.

A locking unit 24 is coupled to the first portion 16 of the central stanchion 14 and the locking unit 24 includes a ring 26 that is positioned around the second portion 18 of the central stanchion 14. The ring 26 is positionable in a releasing condition having the ring 26 being horizontally oriented in the locking unit 24 such that the ring 26 facilitates the second portion 18 to slide freely through the ring 26 for adjusting a height of the second portion 18. Conversely, the ring 26 is positionable in a locking condition having the ring 26 being oriented in a downward angle in the locking unit 24 such that the ring 26 frictionally engages the second portion 18 to inhibit the second portion 18 from sliding through the ring 26.

A locking screw 28 is provided which threadably extends through the first portion 16 of the central stanchion 14. The locking screw 28 engages the second portion 18 of the central stanchion 14 when the locking screw 28 is tightened thereby inhibiting the second portion 18 from sliding in the first portion 16. Conversely, the locking screw 28 disengages the second portion 18 when the locking screw 28 is loosened thereby facilitating the second portion 18 to slide in the first portion 16. An adjusting screw 30 is adjustably positioned in the second portion 18 of the central stanchion 14. The adjusting screw 30 is movable either upwardly or downwardly in the second portion 18 of the stanchion 14.

The adjusting screw 30 extends into the well 22 in the upper end 20 of the second portion 18 of the central stanchion 14. The adjusting screw 30 has an outer surface 32 and the outer surface 32 is threaded. Additionally, the adjusting screw 30 has a top end 34 that is exposed with respect to the upper end 20 of the second portion 18. A collar 36 is rotatably coupled to the second portion 18 of the central stanchion 14 and the collar 36 is positioned around the adjusting screw 30. The collar 36 threadably engages the outer surface 32 of the adjusting screw 30. The adjusting screw 30 is urged upwardly from the second portion 18 when the collar 36 is rotated in a first direction. Conversely, the adjusting screw 30 is urged downwardly in the second portion 18 when the collar 36 is rotated in a second direction. The collar 36 has a pair of handles 38 each extending outwardly from the collar 36 such that each of the handles 38 can be gripped for rotating the collar 36 in the first direction or the second direction.

A pipe holder 40 is provided and the pipe holder 40 is coupled to the adjusting screw 30. The pipe holder 40 has a pair of plates 42 that is each perpendicularly oriented with each other to support a pipe 44. The pipe 44 may comprise a metal pipe, such as steel, iron or other metallic material that can be welded. Additionally, the pipe 44 may be any diameter of pipe that is commonly welded in the pipe fitting industry. Each of the plates 42 has a top surface 46, a bottom surface 48 and a perimeter edge 50 extending between the top surface 46 and the bottom surface 48. The perimeter edge 50 of each of the plates 42 has a first side 52 and the first side 52 of the perimeter edge 50 of each of the plates 42 intersects each other such that the top surface 46 of each of the plates 42 lies on a plane is perpendicularly oriented with each other. Furthermore, an outer wall 54 of the pipe 44 rests on the top surface 46 such that the pipe 44 is positioned in a horizontal orientation.

The pipe holder 40 includes a receiver 56 which extends downwardly from the bottom surface 48 of each of the plates 42. The receiver 56 is aligned with an intersection of the first side 52 of the perimeter edge 50 of each of the plates 42. The receiver 56 has a distal end 58 with respect to the intersection of the first side 52. Additionally, the distal end 58 of the receiver 56 is coupled to the top end 34 of the adjusting screw 30 such that each of the plates 42 angles upwardly from the top end 34 of the adjusting screw 30.

A pair of electromagnets 60 is provided and each of the electromagnets 60 is integrated into a respective one of the plates 42 of the pipe holder 40. Each of the electromagnets 60 produces a magnetic field when the electromagnets 60 are turned on. In this way each of the electromagnets 60 can magnetically restrain the pipe 44 on the pipe holder 40 thereby facilitating the pipe 44 to be precisely welded. Each of the electromagnets 60 has a magnetizing surface 62 lying on a plane that is oriented coplanar with the top surface 46 of the respective plate.

Each of the electromagnets 60 has a housing 64 extending downwardly from the bottom surface 48 of the respective plate. Additionally, each of the electromagnets 60 includes a power switch 66 that is movably integrated into the housing 64, and the power switch 66 on the housing 64 is movable into an on position or an off position. A respective one of the electromagnets 60 is turned on when the power switch 66 associated with the respective electromagnet is positioned in the on position. Conversely, a respective one of the electromagnets 60 is turned off when the power switch 66 associated with the respective electromagnet is positioned in the off position. Each of the electromagnets 60 includes a power supply 68 that is positioned within the housing 64 and each of the electromagnets 60 includes a coil and circuitry that is common to electromagnets 60. Furthermore, each of the electromagnets 60 produces a magnetic field of sufficient strength to restrain a metal object that weighs as much as 2500.0 pounds. In this way the pipe 44 can be held in a level and motionless manner to facilitate the pipe 44 to be precisely welded without shifting or moving.

In use, the ring 26 of the locking unit 24 is lifted into a horizontal orientation to facilitate the second portion 18 of the central stanchion 14 to be lifted to a desired height and the ring 26 is released to retain the second portion 18 at the desired height. Additionally, the locking screw 28 is tightened to further secure the second portion 18 at the desired height. The pipe 44 is laid on the pipe holder 40 and each of the electromagnets 60 is turned on. In this way the pipe 44 is restrained on the pipe holder 40. The collar 36 is rotated in either the first direction or the second direction to facilitate the adjusting screw 30 to make fine adjustments to the height of the pipe 44. In this way the pipe 44 can be precisely located to facilitate a high degree of precision to be achieved when the pipe 44 is welded. Each of the electromagnets 60 is turned off to facilitate the pipe 44 to be removed from the pipe holder 40.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A magnetized pipe stand assembly for holding a metal pipe in a preferred orientation for welding the metal pipe, said assembly comprising:

a tripod having a central stanchion, said central stanchion comprising a first portion slidably receiving a second portion such that said central stanchion has a telescopically adjustable height;

an adjusting screw being adjustably positioned in said second portion of said central stanchion, said adjusting screw being movable either upwardly or downwardly in said second portion of said stanchion;

a pipe holder being coupled to said adjusting screw, said pipe holder having a pair of plates each being perpendicularly oriented with each other wherein said pair of plates is configured to support a pipe; and a pair of electromagnets, each of said electromagnets being integrated into a respective one of said plates of said pipe holder, each of said electromagnets producing a magnetic field when said electromagnets are turned on wherein each of said electromagnets is configured to magnetically restrain the pipe on said pipe holder thereby facilitating the pipe to be precisely welded.

2. The assembly according to claim 1, further comprising a locking unit being coupled to said first portion of said central stanchion, said locking unit including a ring being positioned around said second portion of said central stanchion, said ring being positionable in a releasing condition having said ring being horizontally oriented in said locking unit such that said ring facilitates said second portion to slide freely through said ring for adjusting a height of said second portion, said ring being positionable in a locking condition having said ring being oriented in a downward angle in said locking unit such that said ring frictionally engages said second portion to inhibit said second portion from sliding through said ring.

3. The assembly according to claim 2, further comprising a locking screw threadably extending through said first portion of said central stanchion, said locking screw engaging said second portion of said central stanchion when said locking screw is tightened thereby inhibiting said second portion from sliding in said first portion, said locking screw disengaging said second portion when said locking screw is loosened thereby facilitating said second portion to slide in said first portion.

4. The assembly according to claim 1, wherein:

said second portion of said central stanchion has an upper end, said upper end having a well extending downwardly into said second portion; and said adjusting screw extends into said well in said upper end of said second portion of said central stanchion, said adjusting screw having an outer surface, said outer surface being threaded, said adjusting screw having a top end being exposed with respect to said upper end of said second portion.

5. The assembly according to claim 4, further comprising:

a collar being rotatably coupled to said second portion of said central stanchion, said collar being positioned around said adjusting screw, said collar threadably engaging said outer surface of said adjusting screw;

said adjusting screw being urged upwardly from said second portion when said collar is rotated in a first direction;

said adjusting screw being urged downwardly in said second portion when said collar is rotated in a second direction; and said collar has a pair of handles each extending outwardly from said collar such that each of said handles can be gripped for rotating said collar in said first direction or said second direction.

6. The assembly according to claim 1, wherein each of said plates has a top surface, a bottom surface and a perimeter edge extending between said top surface and said bottom surface, said perimeter edge of each of said plates having a first side, said first side of said perimeter edge of each of said plates intersecting each other such that said top surface of each of said plates lies on a plane being perpendicularly oriented with each other wherein said top surface of each of said plates is configured to have an outer wall of the pipe resting on said top surface.

7. The assembly according to claim 6, wherein:

said adjusting screw has a top end; and said pipe holder includes a receiver extending downwardly from said bottom surface of each of said plates, said receiver being aligned with an intersection of said first side of said perimeter edge of each of said plates, said receiver having a distal end with respect to said intersection of said first side, said distal end of said receiver being coupled to said top end of said adjusting screw such that each of said plates angles upwardly from said top end of said adjusting screw.

8. The assembly according to claim 6, wherein each of said electromagnets has a magnetizing surface lying on a plane being oriented coplanar with said top surface of said respective plate.

9. The assembly according to claim 8, wherein each of said electromagnets has a housing extending downwardly from said bottom surface of said respective plate.

10. The assembly according to claim 9, wherein each of said electromagnets includes a power switch being movably integrated into said housing, said power switch on said housing being movable into an on position or an off position, a respective one of said electromagnets being turned on when said power switch associated with said respective electromagnet is positioned in said on position, a respective one of said electromagnets being turned off when said power switch associated with said respective electromagnet is positioned in said off position.

11. A magnetized pipe stand assembly for holding a metal pipe in a preferred orientation for welding the metal pipe, said assembly comprising:

a tripod having a central stanchion, said central stanchion comprising a first portion slidably receiving a second portion such that said central stanchion has a telescopically adjustable height, said second portion of said central stanchion having an upper end, said upper end having a well extending downwardly into said second portion;

a locking unit being coupled to said first portion of said central stanchion, said locking unit including a ring being positioned around said second portion of said central stanchion, said ring being positionable in a releasing condition having said ring being horizontally oriented in said locking unit such that said ring facilitates said second portion to slide freely through said ring for adjusting a height of said second portion, said ring being positionable in a locking condition having said ring being oriented in a downward angle in said locking unit such that said ring frictionally engages said second portion to inhibit said second portion from sliding through said ring;

a locking screw threadably extending through said first portion of said central stanchion, said locking screw engaging said second portion of said central stanchion when said locking screw is tightened thereby inhibiting said second portion from sliding in said first portion, said locking screw disengaging said second portion when said locking screw is loosened thereby facilitating said second portion to slide in said first portion;

an adjusting screw being adjustably positioned in said second portion of said central stanchion, said adjusting screw being movable either upwardly or downwardly in said second portion of said stanchion, said adjusting screw extending into said well in said upper end of said second portion of said central stanchion, said adjusting screw having an outer surface, said outer surface being threaded, said adjusting screw having a top end being exposed with respect to said upper end of said second portion;

a collar being rotatably coupled to said second portion of said central stanchion, said collar being positioned around said adjusting screw, said collar threadably engaging said outer surface of said adjusting screw, said adjusting screw being urged upwardly from said second portion when said collar is rotated in a first direction, said adjusting screw being urged downwardly in said second portion when said collar is rotated in a second direction, said collar having a pair of handles each extending outwardly from said collar such that each of said handles can be gripped for rotating said collar in said first direction or said second direction;

a pipe holder being coupled to said adjusting screw, said pipe holder having a pair of plates each being perpendicularly oriented with each other wherein said pair of plates is configured to support a pipe, each of said plates having a top surface, a bottom surface and a perimeter edge extending between said top surface and said bottom surface, said perimeter edge of each of said plates having a first side, said first side of said perimeter edge of each of said plates intersecting each other such that said top surface of each of said plates lies on a plane being perpendicularly oriented with each other wherein said top surface of each of said plates is configured to have an outer wall of the pipe resting on said top surface, said pipe holder including a receiver extending downwardly from said bottom surface of each of said plates, said receiver being aligned with an intersection of said first side of said perimeter edge of each of said plates, said receiver having a distal end with respect to said intersection of said first side, said distal end of said receiver being coupled to said top end of said adjusting screw such that each of said plates angles upwardly from said top end of said adjusting screw; and a pair of electromagnets, each of said electromagnets being integrated into a respective one of said plates of said pipe holder, each of said electromagnets producing a magnetic field when said electromagnets are turned on wherein each of said electromagnets is configured to magnetically restrain the pipe on said pipe holder thereby facilitating the pipe to be precisely welded, each of said electromagnets having a magnetizing surface lying on a plane being oriented coplanar with said top surface of said respective plate, each of said electromagnets having a housing extending downwardly from said bottom surface of said respective plate, each of said electromagnets including a power switch being movably integrated into said housing, said power switch on said housing being movable into an on position or an off position, a respective one of said electromagnets being turned on when said power switch associated with said respective electromagnet is positioned in said on position, a respective one of said electromagnets being turned off when said power switch associated with said respective electromagnet is positioned in said off position.

* * * * *